United States Patent [19]

Lin

[11] Patent Number: 4,767,140

[45] Date of Patent: Aug. 30, 1988

[54] TUBULAR LOCK WITH AN ADJUSTABLE DEVICE FOR TWO-SIZE SETTING

[76] Inventor: Jui C. Lin, 297, Bor Ay Rd., Kaohsiung City, Taiwan, 800

[21] Appl. No.: 21,676

[22] Filed: Mar. 4, 1987

[51] Int. Cl.[4] ..... E05B 9/00

[52] U.S. Cl. ..... 292/337; 70/461; 292/169; 292/169.14; 292/DIG. 60

[58] Field of Search ..... 292/337, 1, DIG. 60, 292/DIG. 44, 169.14, 165, 167, 169; 70/143, 461

[56] References Cited

U.S. PATENT DOCUMENTS 1,661,454 3/1962 Wilson ..... 292/337 X
4,372,594 2/1983 Gater ..... 292/337
4,602,490 7/1986 Glass et al. ..... 292/337 X
4,653,787 3/1987 Fang ..... 292/169.14 X
4,662,665 5/1987 Lin ..... 292/167
4,664,433 5/1987 Solovieff et al. ..... 292/DIG. 60 X

*Primary Examiner*—Lloyd A. Gall
*Attorney, Agent, or Firm*—Holman & Stern

[57] ABSTRACT

This invention is a kind of tubular lock with an adjustable device for two-size setting. Changing the lock into two sizes is accomplished by the two different combinations of the U-shaped hole of an inside cylinder with a projected ball of an outside cylinder and the two different combinations of the U-shaped hole of a location tube inside a dead bolt with the teeth of a moving plate.

5 Claims, 4 Drawing Sheets

4,767,140

TUBULAR LOCK WITH AN ADJUSTABLE DEVICE FOR TWO-SIZE SETTING

BACKGROUND OF THE INVENTION

Commonly, door locks are manufactured in either of two sizes, namely 60 mm and 70 mm locks, representing the different distances between an operating aperture and a faceplate of the lock. Therefore, in order to satisfy different needs, manufacturers have to make two different sizes of locks, retailers are obliged to have more space for stocking such locks, and buyers may be confused in selecting locks unless they have a knowledge of same.

SUMMARY OF THE INVENTION

In view of the above noted problems, the inventor has devised a tubular lock with an adjustable device for fixing the lock in either of the two sizes on a door, to simplify manufacture, selling and use of such locks.

DESCRIPTION OF PREFERRED EMBODIMENT

Figure 1:
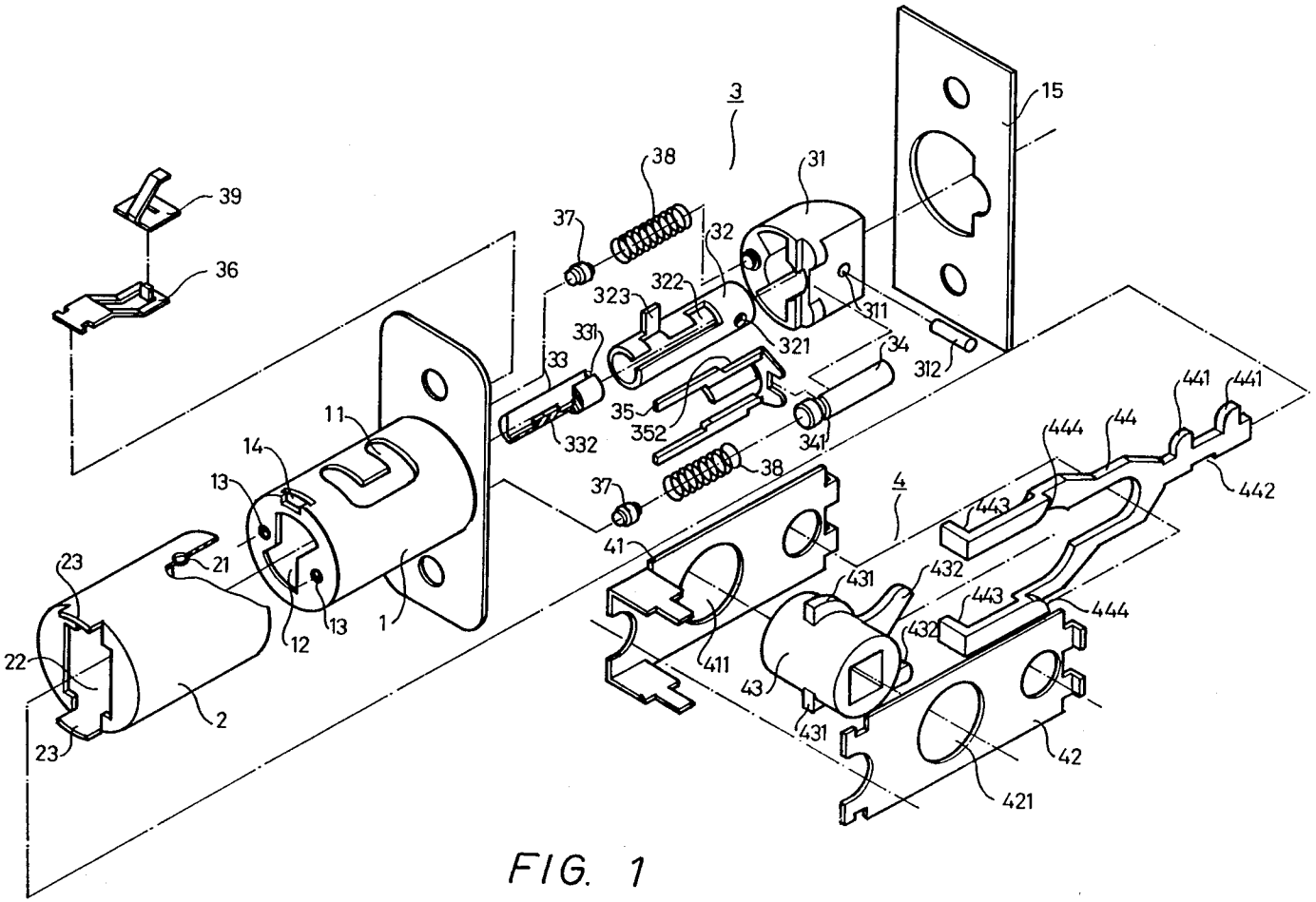
FIG. 1 is an exploded perspective view of a tubular lock according to the invention.

As shown in FIG. 1, the lock comprises an inside cylinder 1, an outside cylinder 2, a dead bolt set 3 and an operating assembly 4.

Inside cylinder 1 has a U-shaped slot 11 for receiving a detent 21 of the outside cylinder 2, for movement therein. In the base of the inside cylinder 1 is formed an aperture 12 for moving parts 4 to pass through, and two pin holes 13 for pins 37 to be inserted in. At the top edge of the inside cylinder 1, is a notch 14 for an anti-burglar piece 36. A face plate 15 is provided for the front of cylinder 1 to hold the dead bolt set in the cylinder after assembly.

Figure 6:
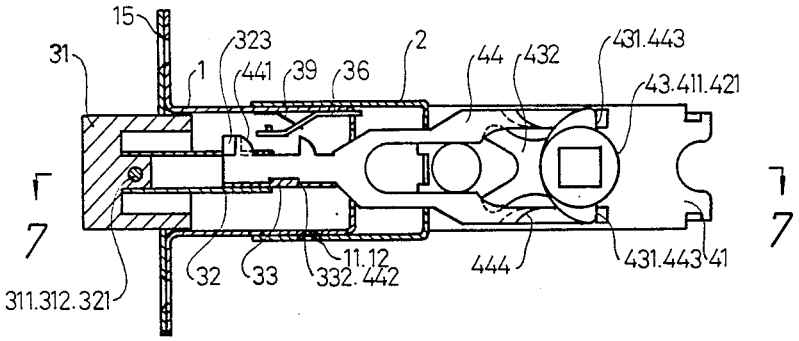
FIG. 6 is a cross-sectional view on line 6—6 of FIG. 7.
Figure 8:
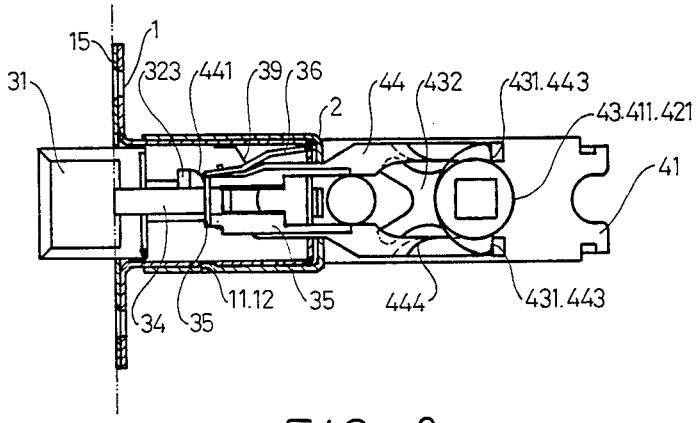
FIG. 8 is a plan view of the lock, part broken away, and adjusted to the 60 mm size.

Outside cylinder 2 is assembled together with inside cylinder with detent 21 able to be moved in U-shaped slot 11 between two different locations in the respective forward and back limbs of the slot, as shown in FIGS. 6 and 8. In the base of outside cylinder 2 is a hole 22 for fixing plates 41, 42 of moving parts 4. The fixing plates 41, 42 are kept separated from each other by means of two protrusions 23.

Dead bolt set 3 includes a dead bolt 31, a location tube 32, a connecting tube 33, an anti-burglar bolt 34, an anti-burglar plate 35, an anti-burglar piece 36, location pins 37 and coil springs 38.

Dead bolt 31 is united with location tube 32 by a pin 312 inserted in pin holes 311 and 321. Location tube 32 has a further U-shaped slot 322 for teeth 441 of a moving plate 44 to fit in, and a wall 323 which is vertically disposed at the rear part of slot 322 and is narrower than the rear part of the slot so that the back of wall 323 is spaced forwardly from the back edge of the slot. Moving plate 44 has two teeth, 441 which are to be fitted in location tube 32. Connecting tube 33 is inserted lengthwise into location tube 32 and twisted, having a groove 331 for moving plate 44 to fit in and a key 332 to locate in a notch 442 in the moving plate.

Anti-burglar bolt 34 engages on dead bolt 31 for movement thereon and is connected with anti-burglar plate 35 by an annular groove fitting in a notch at the forward end of the plate. The anti-burglar plate 35 serves to allow the plate spring 39 selectively to press down the anti-burglar piece 36 to lock the lock. This action will be described later with reference to FIG. 8. Dead bolt 31 and anti-burglar bolt 34 are urged forwardly by coil springs 38. The fixing plates 41, 42 project rearwardly through aperture 22 of outside cylinder 2, and have respective apertures 411 and 421 in which a revolving post 43 is rotatably mounted. There are two pairs of protrusions 431, 432, on the surface of revolving post 43. Protrusions 431 are to be hooked and moved by hooks 443 of moving plate 44 and protrusions 432 by teeth 444. Thus, turning of revolving post 43 causes linear movement of the plate 44.

Plate 44 is united with connecting tube 32 by means of notch 442 in which the key 332 fits. Plate 44 is connected with location tube 32 by means of teeth 441 which can fit in U-shaped slot 332. The two different sizes for setting the lock are obtained by inserting one or both of teeth 441 in slot 322.

Figure 2:
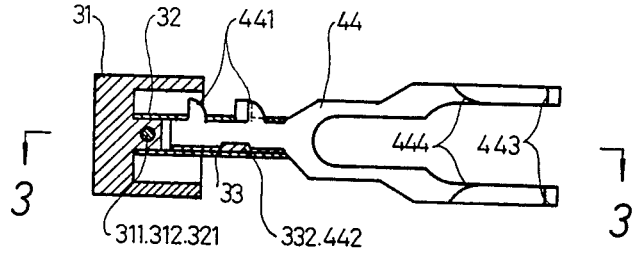
FIG. 2 is a cross-sectional view on line 2—2 of FIG. 3.
Figure 3:
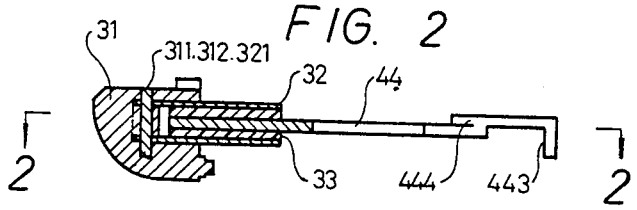
FIG. 3 is a cross-sectional view on line 3—3 of FIG. 2.

FIGS. 2 and 3 show how dead bolt 31, location tube 32, connecting tube 33 and moving plate 44 are assembled together. Pin 312 unites dead bolt 31 with location tube 32, and moving plate 44 and location tube 32 are united by inserting teeth 441 in the U-shaped slot 322.

Figure 4:
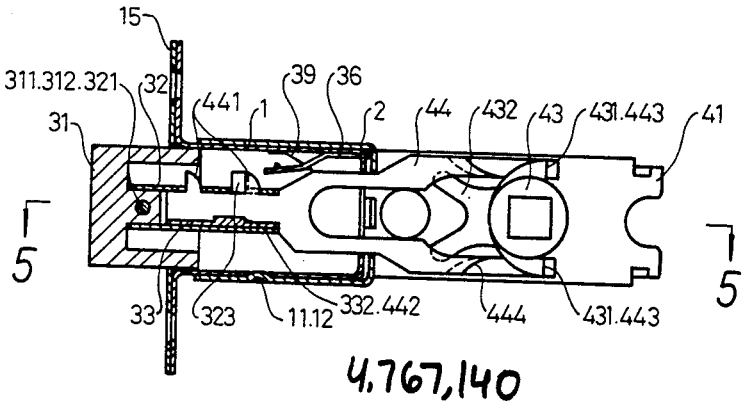
FIG. 4 is a cross-sectional view on line 4—4 of FIG. 5.
Figure 5:
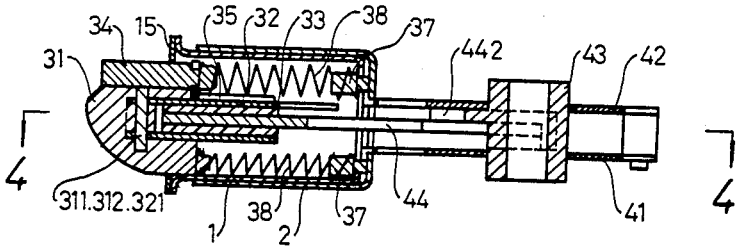
FIG. 5 is a cross-sectional view on line 5—5 of FIG. 4.

FIGS. 4 and 5 show the assembled construction of the lock adjusted to the 60 mm setting size. In this construction, detent 21 of outer cylinder 2 is located in the forward part of U-shaped notch 11, both teeth of 441 of moving plate 44 are inserted in U-shaped notch 322 of location tube 32. Consequently, moving late 44 can pull dead bolt 31 back when the plate 44 is moved by revolving post 43.

Figure 7:
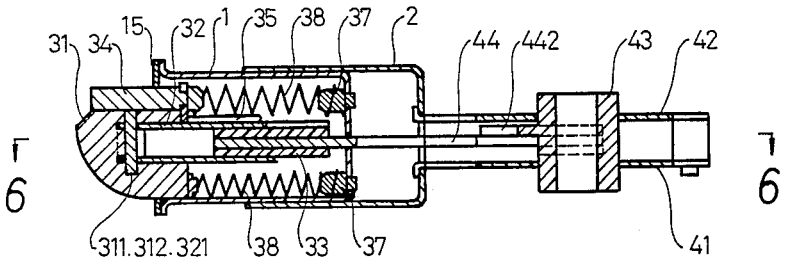
FIG. 7 is a cross-sectional view on line 7—7 of FIG. 6.

FIGS. 6 and 7 show the assembled structure of the lock adjusted to the 70 mm size. In this condition, detent 21 is located in the back part of U-shaped notch 11, and the forward one of teeth 441 of the moving plate 44 is inserted in the back part of U-shaped notch 322 of the location tube 32.

When changing of the setting size is required, for example, to change from the 60 mm size shown in FIGS. 4 and 5 to the 70 mm size shown in FIGS. 6 and 7, this is accomplished by grasping fixing plates 41, 42 and turning the outside cylinder 2 so that the detent 21 moves between the respective limbs of the U-shaped slot 11, with equivalent movement of teeth 441 along the U-shaped notch 322.

The operation of the anti-burglar bolt is now described. When the lock is set in a door and the door has been closed, the anti-burglar bolt 34 is pushed inside of the lock by the door jamb. The anti-burglar bolt 34 pushes burglar plate 35 backwards, and the anti-burglar piece drops against the lower forward edge portion 352 under the influence of spring 39. It is then impossible for dead bolt 31 and tube 32 to be forced back, because the anti-burglar piece will arrest wall 323. Then to unlock the lock, moving plate 44 must be pushed backwards so that the anti-burglar piece 36 may be gradually pushed upwardly by the arcuate surface of one of the teeth 441. Then the anti-burglar piece 36 will no longer block wall 323 of location tube 32, enabling bolt 31 to be pushed back. The locking and unlocking action is the same for the 70 mm and 60 mm size settings of the lock.

Figure 9:
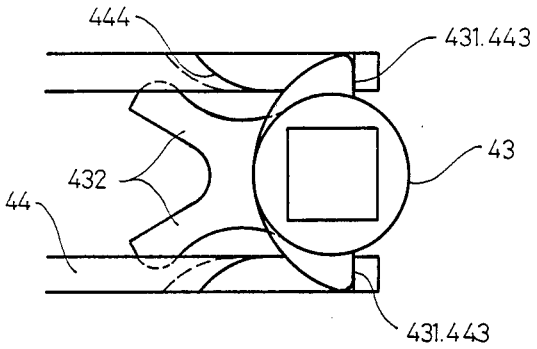
FIG. 9 is a first view of the action of a revolving post against a moving plate in the lock.
Figure 10:
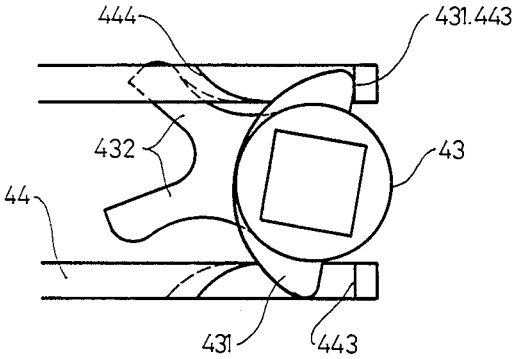
FIG. 10 is a second view of the action of the revolving post against the moving plate.
Figure 11:
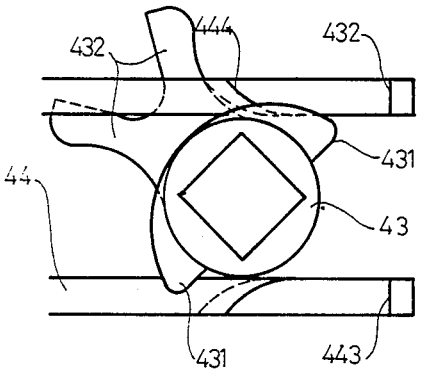
FIG. 11 is a third view of the action of the revolving post against the moving plate.

FIGS. 9, 10 and 11 show the correlative movement of revolving post 43 and moving plate 44. When the post 43 and the plate 44 are stationary, protrusions 431 of the post 43 are engaged by hooks 443 of the plate 44. When the revolving post 43 is turned, whether clockwise or counterclockwise, hook 443 is pushed continuously and the other pair of protrusions 432 are brought into engagement with teeth 444 of moving plate 44 as in FIG. 10. Then, protrusions 431 will continuously push the moving plate 44 backwards.

What is claimed is:

1. A tubular lock with an adjustable device for two-size setting comprising, an inside cylinder having a U-shaped slot for a projected detent to fit and move in between front and back limbs of the slot, a hole at the bottom for moving parts to penetrate through, a notch at the bottom edge for an anti-burglar piece to be lodged in, and a faceplate to cover a dead bolt set therein, an outside cylinder having a projected detent to fit in said U-shaped slot of the inside cylinder, a bottom hole for fixing plates to be connected therewith, and two protrusions at the bottom for keeping said fixing plates separated at a certain distance therebetween, a dead bolt set consisting of a location tube which is combined with a dead bolt with a pin and has a further U-shaped slot disposed lengthwise with front and rear limbs and a vertical wall standing up adjacent the rear limb of said further U-shaped slot, a connecting tube which is placed lengthwise inside said location tube and has a groove for a hook of a moving plate to fit in, the moving plate having teeth for fitting in said further U-shaped slot, and an anti-burglar both beside said dead bolt for hooking up with an anti-burglar plate on which there is an anti-burglar piece pressed down by a plate spring, an operating assembly consisting of two fixing plates which are to be fixed steady at two walls of the bottom hole of the outside cylinder and have a round hole for combining with a revolving post with protrusions which can move the moving plate having teeth which can fit in the further U-shaped slot, and the lock having the characteristic that turning the outside cylinder can make the projected detent move along in the U-shaped slot of the inside cylinder between the respective front and back limbs and at the same time can move the teeth of the moving plate to enter the respective limbs of the further U-shaped slot of the location tube so as to change the lock size.

2. A tubular lock as claimed in claim 1, wherein the teeth of the moving plate have arcuate rear surfaces.

3. A tubular lock with an adjustable device for two-size setting comprising, a cylinder holding various parts assembled inside itself and having at its bottom a hole for two fixing plates to hook with two walls of the hole, two protrusions to keep the fixing plates separated from each other, and a faceplate for setting the lock on a door, two fixing plates having respective keys to hook with two walls of the bottom hole of the cylinder, and each having a round hole for a revolving post to rest and rotate therein, in a dead bolt combined by a pin with a location tube, which has a vertical wall and a slot beside the wall for receiving teeth of a moving plate, a revolving post having a square shaft hole for a revolving shaft of a knob, one pair of teeth on said post for engaging hooks of a moving plate, and another pair of teeth on said post for moving shoulders of the moving plate, a moving plate having an unlocking tooth fitting in the slot of the location tube so as to move it, two hooks at its end for engagement with one pair of the teeth of the revolving post, and a pair of shoulders for engagement with the second pair of teeth of the revolving post, an anti-burglar set having an anti-burglar bolt connected with an anti-burglar plate having a stepped edge, an anti-burglar piece mounted lengthwise in the cylinder for engaging said edge of the anti-burglar plate, movement of the anti-burglar bolt and anti-burglar plate moving the anti-burglar piece between stepped portions of said edge into and out of blocking engagement with said vertical wall of the location tube, and the revolving post has two pairs of teeth for engaging respective pairs of projections on the moving plate so that the moving plate can pull the dead bolt backward by rotation of the revolving post.

4. The tubular lock as claimed in claim 3, wherein the unlocking tooth of the moving plate has an arcuate surface to engage and elevate the anti-burglar piece by the movement of the moving plate when the dead bolt is retracted into the cylinder whereby the anti-burglar piece is moved out of blocking engagement with the vertical wall.

5. The tubular lock as claimed in claim 3, wherein the unlocking tooth of the moving plate is wider than the width of the location tube so that the unlocking tooth may elevate the anti-burglar piece by means of its arcuate surface and consequently the anti-burglar piece may not be blocked by the vertical wall of the location tube, which location tube can then move backward.

* * * * *